United States Patent [19]

Cass

[11] Patent Number: 4,826,264

[45] Date of Patent: May 2, 1989

[54] SECURITY CLOSURE

[76] Inventor: Philip Cass, Cooper Shore, Cooper Shaw Road, West Tilbury, Essex, Great Britain

[21] Appl. No.: 68,660

[22] Filed: Jul. 1, 1987

[30] Foreign Application Priority Data

Jul. 2, 1986 [GB] United Kingdom ..... 8616172

[51] Int. Cl.[4] ..... A47B 51/00

[52] U.S. Cl. ..... 312/312; 49/102; 49/443; 109/17; 109/87; 160/137; 160/202

[58] Field of Search ..... 312/312, 139; 109/15, 109/17, 18, 87; 160/37, 202, 189, 188; 49/33, 102, 443

[56] References Cited

U.S. PATENT DOCUMENTS

| | | | |
|---|---|---|---|
| 757,178 | 4/1904 | Cross | 49/102 |
| 916,288 | 3/1909 | Fish | 160/202 |
| 1,074,932 | 10/1913 | Dickenson | 312/312 X |
| 1,810,496 | 6/1931 | Peele | 49/102 |
| 1,925,632 | 9/1933 | Freda | 109/17 |
| 2,695,574 | 11/1954 | Ceci | 109/17 |
| 3,614,974 | 10/1971 | Tajima | 160/188 |

FOREIGN PATENT DOCUMENTS 1485076 9/1977 United Kingdom .

*Primary Examiner*—Joseph Falk
*Attorney, Agent, or Firm*—Auslander & Thomas

[57] ABSTRACT

A domestic security closure in a form of a cabinet having a front opening (9) defined at the top of a framework (2) partially embedded in the floor and providing a guide for a pair of rigid steel doors (10,12) which can be lifted by use of a counter-weighted chain drive system (20,21,24,25) from a retracted position below floor level (8) to a raised position in which they are locked in place securely to close the cabinet, for instance using a mortise deadlock (29) and a locking bar (27). The flush floor enables entry of relatively bulky and valuable items without lifting.

4 Claims, 2 Drawing Sheets

SECURITY CLOSURE

Figure 1:
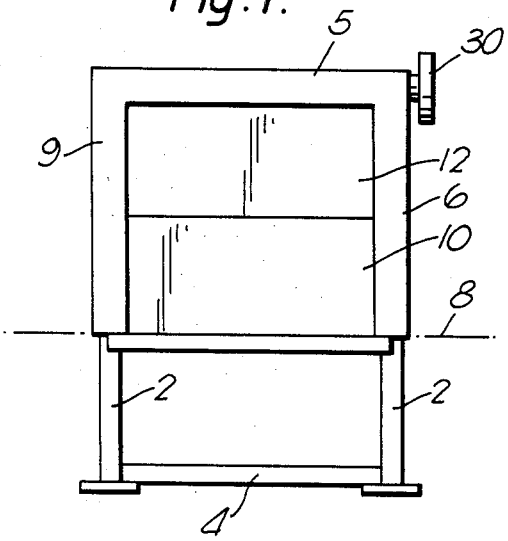

This invention relates to a security closure, more particularly a floor standing security cabinet especially but not exclusively designed for housing expensive but relatively heavy and bulky items of domestic equipment such as television sets, video recorders, computers and the like. Small valuables such as jewellery or cameras can readily be stored and locked in a safe for security purposes. However, larger items as mentioned above can not normally be locked away in this manner because they are either too large or too heavy to be fitted or lifted into the safe.

It is known from British Pat. No. 1485076 to provide a safe in an inner storage case received within an outer protective casing, the inner case being retractable from a raised position, in which access can be gained to its interior, to a lowered position in which it is wholly within the outer protective casing and access thereto is prevented. The inner casing is raised and lowered into and out of the protective outer casing by hydraulic means. The problem with this arrangement is that the whole of the inner casing has to be raised and lowered so powerful and expensive hydraulic lifting means are needed to cope with the load.

It is an object of the invention, therefore, to provide a security closure in which only the doors thereof are raised and lowered to gain access thereto.

According to one aspect of the invention, there is provided a security closure comprising a cabint closed by a pair of vertically movable doors normally retracted below the level of the floor of the cabinet but which can be raised and locked in their raised position.

Preferably the doors are moved by means which simultaneously raise them from a lowered position in which they are aligned with each other, one behind the other, to a raised position in which one door is located above the other to secure the closure.

Conveniently, the invention provides a security closure system which comprises of framework for partially embedding in a floor to define a cabinet opening at its upper exposed part, a pair of rigid doors slidable vertically in the framework to close the cabinet when in their raised position but to be retracted into the floor when the cabinet is opened, and means for locking the doors relative to the frame work in their raised position in order to lock the cabinet securely closed.

Preferably the invention provides a cabinet having a floor flush with the external floor (and generally constituted by the same floor) and a pair of rigid doors which are fully retractable into the floor to enable large items to be admitted to the cabinet, for instance by sliding or wheeling, without having to lift them.

To a greater or lesser extent, the back and sides of the cabinet may be defined by the physically secure walls of the building but steel side walls and a back wall may form part of the cabinet of the invention when there are no strong structural walls available.

In a preferred embodiment, one of the vertically movable doors has a lip on it to engage with a corresponding lip on the other door when the two doors are in their raised position thereby securing the doors from separation.

Conveniently the doors are moved by a chain drive system, preferably counter-weighted, the system including a drive wheel which is exposed to the exterior of the cabinet to enable manual operation of the chain drive and thereby the vertically movable doors. The chain drive can be on one side of the closure or both sides if desired.

In a preferred embodiment, the closure includes locking means which may be in the form of an apertured bar provided at the top of the closure into which locking elements on the upper door penetrate when said door is raised, the bar being laterally displacable by the operation of a locking device, such as a mortise dead lock, to obstruct downward movement of the locking elements penetrating therethrough. In a preferred arrangement, the doors can be locked in their retracted position because the locking bar carries a part which engages the or each counter weight to obstruct movement thereof associated with door closing when the lock is operated. Conveniently the locking bar is operable by the mortise dead lock.

For convenience, the closure preferably includes a pivotted floor flap covering the floor gap through which the doors pass, this flap being lifted by the upper edge of the upper door on raising the latter to close the cabinet.

Figure 2:
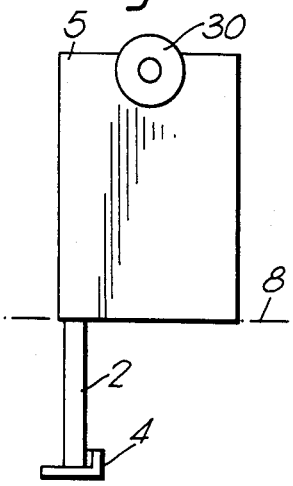
Figure 3:
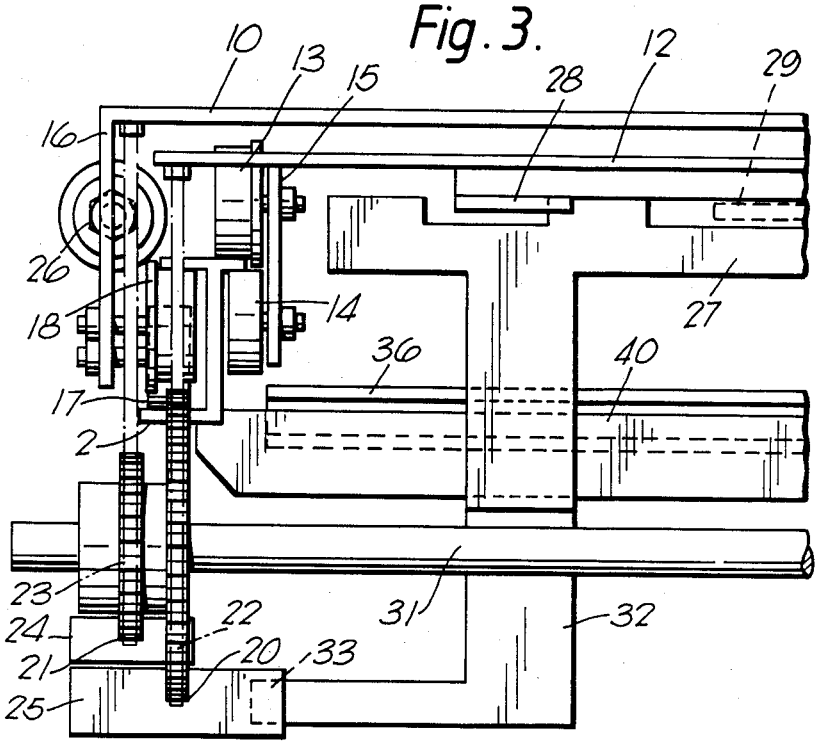
Figure 4:
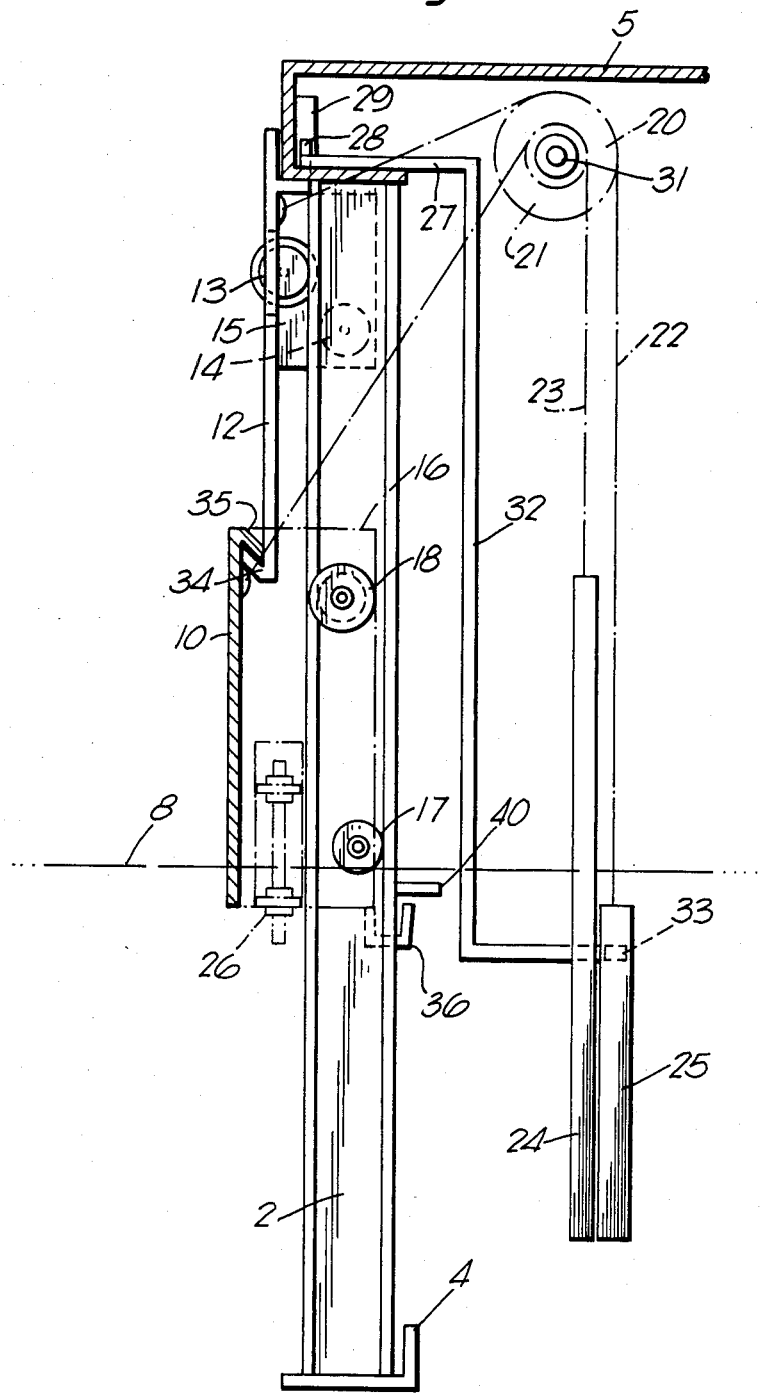

It is a feature of the preferred cabinet of the invention that the means for raising and lowering the doors is operable to reduce the speed of travel of the upper door as it approaches its fully raised position. A preferred security closure of the invention will now be described, by way of example only, with reference to the accompanying diagrammatic drawings, in which:

FIG. 1 is a front view of the arrangement of the basic cabinet structure with the parts below floor level visible as through the ground beneath the floor is transparent, FIG. 2 is a corresponding side view of the arrangement shown in FIG. 1, FIG. 3 is a scrap view in plan showing the counter weighted chain drive system for the doors and FIG. 4 is a side view of the arrangement shown in FIG. 3, the doors being shown in their raised position.

Referring to FIG. 1, there is shown a framework comprising two uprights 2 and a lower cross-member 4 (the upper cross member is not visible). This framework is embedded vertically into the ground or floor structure of a building. The floor level is indicated at 8. The upper part of the framework above floor level defines front opening 9 of a security cabinet which is closed by a pair or vertically movable doors 10,12. The location where the framework is partially embedded in the floor may be the entrance to a recess in a house, in which case the walls of the recess will provide the side and back walls of the closure. Otherwise, the framework may form part of a larger framework intergrated with one or more steel side walls or a steel back wall of the closure. The floor of the cabinet or closure is provided by the floor of the house. Alternatively, it may be the top of a plynth on which the cabinet stands, the doors retracting into the plynth.

A roof 5 is associated with the uprights 2 which, in the illustrated example, is intergrated with the cabinet side walls 6, it being assumed that the back wall will be provided by a wall of the house.

The two doors 10, 12 are made of steel and slide vertically between the uprights 2. When the cabinet is open both doors are retracted below the floor level 8, a pivotted flap (not shown) normally covering the gap in the floor from which the doors emerge, this flap being lifted by the upper door 12 as it is raised.

The upper steel door 10 has an extension 15 (see FIG. 3) at both side edges on which guide rollers 13,14 are mounted. The guide rollers 13 run along the front face and side edge of the generally "H" shaped uprights 2 while the rollers 14 run along the reverse face thereof for increased stability.

The lower steel door 10 also has similar extension plates 16 attached to each side of it to support guide wheels 17, 18 which also run along the uprights 2. An adjustable stop arrangement 26 (see FIG. 4) is provided on the lower part of one or both extension plates 16

The doors 10,12 are raised and lowered by a counter-weighted drive system shown in more detail in FIGS. 3 and 4. In the illustrated example, Pulleys 20, 21 are provided on one side of the upper part of the cabinet over which respective drive chains 22, 23 pass, one end of each chain being connected to a respective door and the other end being connected to a counter-weight 24, 25. A drive wheel 30 (see FIGS. 1 and 2) is exposed on the outside of the cabinet to enable manual operation of the doors through its counter-weighted chain drive. The drive wheel 30 is fitted to the same shaft 31 as the pulleys 20, 21. If required, additional pulleys and counter-weights can be attached to the opposite end of shaft 31. Furthermore, a power drive could be provided instead of the manual drive system just described.

The locking means for the doors 10, 12 is show in Figures 3 and 4 and comprises a laterally movable apertured roof bar 27. Hooked latching elements 28 are provided on the upper edge of the upper door 12 to penetrate the apertures in the locking bar 27 when the upper door is elevated to its fully raised position. The bar 27 may then be laterally displaced by operation of a mortise deadlock 29 to block downward movement of the hooked latching elements and thereby lock the door securely closed. The lower edge of the lower door 10 has a flange 36 extending from it (see FIG. 3) which engages behind a cross piece (40) extending between the uprights 2 to prevent levering of the doors out of the framework.

An extension 32 from the locking bar 27 has an end 33 which terminates adjacent the counter-weight 25 to the upper door. Thus, if the lock is actuated while both doors are lowered, the end 33 is moved beneath counterweight 25 to prevent the upper door from being raised accidentally.

Referring to FIG. 4, it can be seen that the bottom edge of the upper door 12 is provided with an upturned lip 34 which engages with a downturned lip 35 on the top edge of the lower door 10 for added security when both doors are in their fully raised position.

In operation, the two doors 10, 12 would normally be at rest in their lowered position along side each other beneath the floor 8. In this position, the counterweights 24, 25 would be lifted up higher than their position shown in FIG. 4. On turning the drive wheel 30, shaft 31 is rotated with the two drive pullyes 20, 21 keyed to it. As the drive pulley 21 is smaller in diameter than the pulley 20, the chain driven by it moves a lesser distance than the chain driven by the larger pulley 20. Furthermore, because the angle of the chain relative to the pulley 20 for the upper door increases the higher the door moves, the chain increasingly exerts less of an upwrad pull on the door so the rate of closing of the upper door slows down the nearer it gets to its fully raised position.

In use, when the doors are opened, i.e. in their fully retracted position below floor level, valuable bulky items such as television sets or video recorders may be wheeled or otherwise admitted into the cabinet without lifting. When the door is closed and locked by operation of the mortise deadlock and locking bar, a secured closure is formed to protect the stored items against theft and possibly if desired against fire. If desired, an alarm system may be incorporated.

The preferred arrangement just described and illustrated in the drawings may be modified in various ways within the scope of the invention, especially in respect of the manner in which the doors are guided for movement and the way in which the manual or power-drive is transmitted to the doors. The locking means may also be subjected to modification but it is generally preferable to retain a mortise deadlock or equivalent locking device for securing the locking bar or other locking element which latches the doors in their raised position in which the cabinet is closed. It will also be apparent that the closure can be made in any size necessary to suit the dimensions and quantity of equipment which it is required to store in a secure manner. As a development of the invention, the cabinet can be adapted for use as a vandal proof closure for use in public places to house, for instance, fire extinguishers. Such a cabinet would have its doors kept in their raised position by a solenoid operated bolt, which when released, would allow the doors to drop quickly into the ground giving access to the fire extinguishers in a matter of seconds. After use, the doors would be raised manually again in the manner already described and locked in their raised position by means of a solenoid operated bolt. It will be appreciated that if cabinets such as these were used in a sports stadium, all the bolts would be connected to a central control operated by a stadium official.

I claim:

1. A security closure comprising a cabinet closed by a pair of vertically movable doors, said cabinet having a floor substantially flush with an external floor, said cabinet including a framework partially embedded in said external floor to define a cabinet opening, said doors normally retracted below the level of said floor of said cabinet in said framework one door behind the other, said doors adapted to be raised in said framework, means for moving said doors simultaneously raising them from said retracted position to a raised position one above the other, said means for moving said doors including each door having a chain connected to its upper edge, each said chain passing over a pulley, each said chain having a counterweight attached to its free end, each said pulley located near the top of said cabinet, each said pulley near the top of said cabinet located behind and spaced away from said upper door's raised position, the angle between said upper edge of said upper door and said pulley increasing as said upper door elevates in height, whereby said upper door decelerates as it approaches its fully raised position, means for locking said closure, said locking means comprising an apertured bar provided at the top of said framework into which locking elements on said upper door penetrate when said door is raised, said bar being laterally displacable by operation of a locking device to obstruct downward movement of said locking elements penetrating therethrough, said doors being lockable in their lowered position by a part carried by said apertured bar adapted to engage a counterweight to obstruct movement thereof associated with door closing.

2. A closure as claimed in 1 wherein said moving means includes a drive wheel, a chain drive, said drive wheel connected to said chain drive, said drive wheel including a part exposed to allow the exterior of said cabinet adapted to manual operation of said chain drive.

3. A closure as claim in claim 1 wherein said apertured bar is operable by a mortise deadlock.

4. A closure as claimed in claim 3 including a gap in said framework at said external floor, a pivoted floor flap covering said floor gap through which said doors pass, said floor flap adapted to be lifted by the upper edge of said upper door on raising said upper door to close the cabinet.

* * * * *